United States Patent [19]

Fox et al.

[11] Patent Number: 4,844,822

[45] Date of Patent: Jul. 4, 1989

[54] SOFTENER/ANTISTAT COMPOSITIONS

[75] Inventors: Priscilla S. Fox, Phoenix; Barbara J. Felthouse, Scottsdale, both of Ariz.

[73] Assignee: The Dial Corporation, Phoenix, Ariz.

[21] Appl. No.: 69,640

[22] Filed: Jul. 6, 1987

[51] Int. Cl.[4] ..... D06M 13/00

[52] U.S. Cl. ..... 252/8.8

[58] Field of Search ..... 252/8.8

[56] References Cited

U.S. PATENT DOCUMENTS

| | | | |
|---|---|---|---|
| 3,546,115 | 12/1970 | Gill | 252/8.8 |
| 3,850,818 | 11/1974 | Katsumi | 252/8.8 |
| 3,862,045 | 1/1975 | Sato | 252/8.75 |
| 3,904,359 | 11/1975 | Ramachandran | 8/137 |
| 4,024,204 | 5/1977 | Schlichting | 252/857 PE |
| 4,102,825 | 7/1978 | Murata | 252/547 |
| 4,298,480 | 11/1981 | Wixon | 252/8.75 |
| 4,326,714 | 4/1982 | Wixon | 252/8.75 |
| 4,327,133 | 4/1982 | Rudy | 427/242 |
| 4,329,237 | 5/1982 | Wixon | 252/8.75 |
| 4,411,803 | 10/1983 | Wixon | 252/8.75 |
| 4,411,803 | 10/1983 | Wixon | 252/8.75 |
| 4,450,085 | 5/1984 | Wixon | 252/8.75 |

FOREIGN PATENT DOCUMENTS

| | | |
|---|---|---|
| 886856 | 4/1981 | Belgium . |
| 160551 | 10/1975 | Czechoslovakia . |
| 2832679 | 2/1979 | Fed. Rep. of Germany . |
| 57-170931 | 10/1982 | Japan . |
| 60-33375 | 2/1985 | Japan . |
| 1550206 | 8/1979 | United Kingdom . |
| 1584562 | 2/1981 | United Kingdom . |

OTHER PUBLICATIONS

J. A. Ackerman *How To Choose Cationics For Fabric Softners,* JAOCS, vol. 60 No. 6 Jun. 1983 pp. 1166–1169.

R. R. Egan *Cationic Surface Active Agents as Fabric Softeners,* JAOCS, Jan. 1978, vol. 55, pp. 118–121.

*Primary Examiner*—John F. Niebling

*Assistant Examiner*—Isabelle Rodriguez

*Attorney, Agent, or Firm*—Richard G. Harrer; Bernard L. Howard

[57] ABSTRACT

Compositions capable of providing effective softness and antistatic properties to fabrics laundered therewith even when such compositions are added to the wash cycle along with built anionic based detergents. The compositions include a combination of ethoxylated or propoxylated quaternary ammonium compounds, a mono-higher alkyl quaternary ammonium compound and powdered nylon and can be formulated in granular or liquid form.

14 Claims, No Drawings

SOFTENER/ANTISTAT COMPOSITIONS

FIELD OF THE INVENTION

This invention relates to fabric treating compositions and more particularly, to compositions capable of imparting softness and antistatic properties to fabrics laundered therewith. The compositions of this invention are eminently suitable for addition to the wash cycle of a fabric laundry process and provide both effective softening and static control for such fabrics.

BACKGROUND OF THE INVENTION

The softening of fabrics during a laundering operation has been a part of the scene for about 30 years, beginning in the era when synthetic detergents began replacing soaps to launder fabrics. As long as soap was used for laundering, the hard water soap film left on the fabric provided the lubrication needed for a pleasing fabric hand. With the advent of synthetic detergents the need for a fabric softener was established.

The original fabric softeners were aqueous dispersions of cationic quaternary ammonium compounds such as the di (hydrogenated tallow) dimethyl ammonium chlorides and were added to the rinse cycle of the laundering operation.

With further technological changes responsible for the wide growth in synthetic fabrics, coupled with the increased use of automatic laundry dryers in the home, the importance of the softening effects of fabric softeners diminished somewhat, but the ability to eliminate static build-up on fabric became increasingly important. It was learned that fabric softeners could assist in reducing or preventing static in laundered fabrics which led to the discovery that softeners could be applied in the dryer as well as in the washing machine. The addition of a fabric softener to the fabric in the laundry dryer seems to improve static control but is actually less efficient in softening the fabric in that dryer added fabric softener sheets transfer to the fabric load a significantly less amount of fabric softener as do the wash or rinse cycle added products. The softener that is transferred in the dryer is concentrated on the surface of the fabrics and the result is that the softening effects are minimized, although the anti-static effect is improved. With the advent of the nonionic detergents, it was found that the cationic softeners could be incorporated into the wash cycle as well. It had been previously recognized that the addition of cationic fabric softeners along with anionic based detergents in the wash cycle, substantially reduced both the cleaning efficiency of the detergent and the efficiency of the fabric softener. Thus there exists a need for a composition that can be added to the wash cycle or rinse cycle of the laundering operation and which provides both effective softening and anti-static control while maintaining detergent efficiency with a wide range of detergents that include built anionic based products.

SUMMARY OF THE INVENTION

The present invention is based upon the discovery that a composition comprising the combination of powdered nylon, ethoxylated or propoxylated quaternary ammonium compounds and a mono-higher alkyl quaternary ammonium compound is effective in providing softness and anti-static properties to various types of fabrics such as cotton, cotton/synthetic fiber blends and synthetics, treated therewith in a laundering process.

Such composition is effective when added to either the wash cycle or the rinse cycle of the laundering process.

Nylon is the generic term for a long chain synthetic polyamide having recurring polyamide groups (—CONH—) as an integral part of the polymer chain. It is usually made from various combinations of dibasic acids, diamines and amino acids or by addition polymerization. Shorthand nomenclature of nylons involves the use of numbers. That is, a single numeral indicating the number of carbon atoms in a monomer, e.g., nylon 6 has 6 carbon atoms in a monomer. Two numbers indicate a polymer formed from diamines and dibasic acids, the first number indicating the number of carbon atoms separating the nitrogen atoms of the diamine, the second number indicating the number of straight chain carbon atoms in the dibasic acids, e.g., nylon 6, 6. The nylon or polyamide used in the composition should be in powder form and preferably as an ultra fine powder. By ultra fine powder form is meant a particle size ranging from about 5 microns to about 40 microns. A series of ultra fine polyamide powders is available under the trademark "Orgasol". Preferably nylon 6 and nylon 12 ultra fine powders are used.

The ethoxylated quaternary ammonium compounds useful in the compositions are aliphatic cationic compound characterized by the structure:

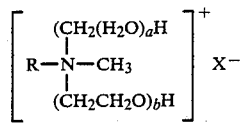

wherein R represents alkyl or alkenyl of 8–18 carbon atoms, and each of a and b are at least 1 and wherein the sum of a and b is from 2 to 50 and X is $Cl^-$ or $CH_3SO_4^{--}$. Ethoxylated compounds of this type include methyl bis (2 hydroxy-ethyl) coco ammonium chloride available commercially as Ethoquad C/12 from Armak Chemicals; Ethoquad C/25 which is the same as Ethoquad C/12 but wherein each of a and b represent 15 moles of ethylene oxide; Ethoquad 18/12 which is the same as Ethoquad C/12 except that R is octadecyl.

Propoxylated quaternary ammonium compounds useful in the composition are also aliphatic cationic compounds characterized by the structure:

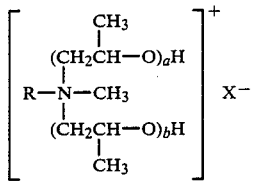

wherein R represents alkyl or alkenyl of 8–18 carbon atoms, and each of a and b are at least 1 and wherein the sum of a and b is from 2 to 50 and X is $Cl^-$ or $CH_3SO_4^{--}$.

Such propoxylated compounds include Propoquad T/12 which is methyl bis (2 hydroxy-propyl) tallow ammonium methyl sulfate; Propaquad C/12 which is the same as Propoquad T/12 except that R is coco; and Propoquad HT/12 which is the same as Propoquad T/12 except that R is hydrogenated tallow. All of the foregoing are available from Armak Chemicals.

The foregoing are relatively ineffective as fabric softeners although they are considered to be reasonably effective as antistats in combination with unbuilt nonionic detergents.

The monoalkyl quaternary ammonium compounds are also aliphatic cationic compounds that conform to the formula:

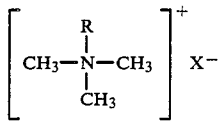

wherein R represents alkyl or alkenyl of 8 to 18 carbon atoms, preferably 12–18 carbon atoms, and X is $Cl^-$ or $CH_3SO_4^-$. Examples of the foregoing include trimethyl tallow ammonium chloride, trimethyl octadecyl ammonium chloride, trimethyl coco ammonium chloride, trimethyl hydrogenated tallow ammonium chloride and the like. The foregoing are commercially available from Armak Chemicals under the trademark "Arquad". Although the di-higher alkyl quaternary ammonium chlorides (i.e., distearyldimethylammonium chloride) are considered to be effective as softeners, particularly in the rinse cycle of a laundering process, the mono-higher alkyl compounds are in fact relatively ineffective as fabric softeners or as antistats. However, when such mono-higher alkyl quaternaries are combined with the ethoxylated and/or propoxylated quaternary ammonium compounds along with powdered nylon, the result is a very effective fabric softening/antistat composition even when used in the wash cycle of a laundering operation and with built anionic based detergents.

The compositions of this invention can be formulated in either liquid or granular form.

In granular form the composition will contain from about 7% to about 18% by weight of the ethoxylated and/or propoxylated quaternary, with the preferred amount being from about 10% to about 16% by weight. It will be appreciated that the foregoing quaternary ammonium compounds are available only as fluids (ranging from about 70–95% active) and it is difficult to get a free-flowing granular composition at levels of such quaternaries much higher than about 18% by weight. The mono-higher alkyl quaternary ammonium compounds are present at from about 0.10% to about 1.0% by weight. Preferably the level of this quaternary is such that the ratio of ethoxylated and/or propoxylated quaternary to the mono-higher alkyl quaternary present in the composition is from about 180:1 to about 18:1, most preferably about 40:1 to about 50:1. All of the foregoing amounts are calculated on a 100% active basis, that is a pure compound. These quaternaries are not commercially available as pure compounds and thus the foregoing amounts are subject to change depending on the percentage or amount of the compound in the commercially available product. For example, methyl bis (2 hydroxy propyl) tallow ammonium chloride is available as a 75% active product. Trimethyl tallow ammonium chloride is available as a 26–29% active product. The nylon powder is present at from about 8% to about 15% by weight. Interestingly, the amount of nylon powder used seems to be somewhat dependent on the type of nylon; with lower levels of nylon 12, around 8% being very effective and higher levels, about 14% of the nylon 6 being most effective.

Additional ingredients in the granular product include water soluble alkaline to neutral builder and filler salts in amounts up to about 80% by weight of the total composition as a carrier. Useful herein are the organic and inorganic builders including the alkali metal and alkaline earth metal phosphates, particularly the condensed phosphates such as the pyrophosphates or tripolyphosphates, silicates, borates, carbonates, bicarbonates and the like. Specific examples of such carrier materials include sodium tripolyphosphate, trisodium phosphate, tetrasodium pyrophosphate, sodium acid pyrophosphate, sodium monobasic phosphate, sodium dibasic phosphate, sodium hexametaphosphate, alkali metal silicates, sodium carbonate, sodium sulfate, borax, and the like and mixtures of the foregoing. Carrier salts may be selected so as to provide either a phosphate containing or phosphate free composition. Sodium carbonate and sodium sulfate are effective if a phosphate free composition is desired.

Other ingredients useful herein include fumed silica to promote the free flowing nature of the granular form, optical brighteners or bluing agents, and perfume.

To produce the granular composition, the dry builder and/or filler salts such as sodium tripolyphosphate and sodium sulfate are mixed together. The liquid materials, that is the ethoxylated and/or propoxylated quaternaries, the mono-higher alkyl quaternary, perfume and colorant are mixed together. Thereafter, the liquid material is added to the dry blend of builder and/or filler salts and mixed until thoroughly blended together. The powdered nylon is then added and mixing is resumed for a short period of time, usually about 10 seconds. Following the mixing, the product can be spread out in pans and allowed to dry at ambient temperature for about ½ hour and thereafter screened and packaged.

In formulating the composition in liquid form the constraints as to the amounts of the various quaternary ammonium compounds and consequently the amount of powdered nylon are not present as with the product in granular form. In fact, it is possible to formulate a liquid product containing only the various quaternary ammonium compounds and powdered nylon with no other diluents or solvents other than those that are contained in the commercially available components. However, depending on the useage directions, the composition will usually contain enough other liquids, usually water, so that from about 4 to about 8 ounces is added to a normal full load of laundry.

To prepare a composition in liquid form the cationic quaternaries are mixed together. Thereafter, if water is to be included it is added and mixing is continued for about 5 minutes. Thereafter the powdered nylon is slowly added to the liquid mixture while continuing the mixing until a smooth consistency is obtained. A somewhat more stable product results if a material such as sodium carboxymethylcellulose (CMC) is added. In formulating a composition containing CMC, the CMC is slowly added to hot water (130° F.) to prevent lumping. When all the CMC is dispersed, the cationics along with any perfume is slowly added with mixing to the water-CMC dispersion. Mixing is continued until the composition is clear. Thereafter, the powdered nylon is slowly added while mixing and mixing is continued until a smooth consistency results.

The following examples are given for purpose of illustration only and are not intended to limit the invention. All parts and percentages are given by weight.

EXAMPLE I

Compositions in granular form were prepared having the following components:

| COMPONENT | A | B | C | D | E |
|---|---|---|---|---|---|
| Carrier-light density STPP | 50.0 | 50.25 | 50.25 | 50.25 | 50.25 |
| Filler-sodium sulfate | 8.0 | 8.04 | 8.04 | 8.04 | 8.04 |
| Ultra-fine nylon 6 (Orgasol 1002D) | 15.0 | — | 14.58 | 14.58 | 14.58 |
| Tallow-methyl-bis (2 hydroxy propyl) ammonium methyl sulfate (Propoquad T/12)* | 17.0 | 17.08 | 11.71 | 17.08 | — |
| Trimethyl tallow ammonium chloride (Arquad T-27W)** | — | 1.0 | 0.69 | 1.0 | 1.0 |
| Flow aid (Sylox 15) | 0.5 | 0.5 | — | 0.5 | — |
| Water | 9.5 | 23.13 | 14.73 | 8.55 | 26.13 |
| | 100.0 | 100.00 | 100.00 | 100.00 | 100.00 |

*as is basis - product is 75% active
**as is basis - product is 27% active

EXAMPLE II

The compositions of Example I were evaluated for fabric softening and static control according to the following procedure:

The testing was done using a standard washing machine (Whirlpool) and electric dryer (Whirlpool). The samples of fabric to be laundered weighed 5.50 pounds and included 4 stripped color coded terry cloth swatches and the following fabric pieces, 2 polyester textured knits, 2 polyester jersey double knits, 4 pieces of Dacron/cotton sheeting material, and 2 yards each of 100% cotton print cloth, cotton broadcloth and nylon.

The controls of the washing machine were set for warm (104° F.) wash, cold rinse, high agitation, high spin and the appropriate water level. The wash time was set at 10 minutes. The machine was filled to the appropriate water level and 1 cup of a commercially available built anionic synthetic detergent and ½ cup of a composition of Example I was added. After allowing the machine to agitate for about 5 seconds, the samples of fabric were added and washed. Following washing, the load was transferred to the dryer and dried for about 50 minutes with the controls set for heavy fabric and high temperature. After drying was completed, all pieces of fabric were removed from the dryer and individually evaluated for static. The terry cloth swatches were evaluated for softness.

The evaluation for static and softness was made by skilled evaluators according to the following criteria:

STATIC EVALUATION

1. Severe static: fabrics cling together with shocking and a crackling sound upon manipulation of the fabric.
2. Moderate static: no clinging together of the fabric or shocking sensation upon handling the fabric but a slight cracking sound upon manipulation of the fabric.
3. Light static: some of fabric gravitates in any direction.
4. No static: no clinging, shocking or crackling observed upon manipulation of the fabric.

SOFTNESS EVALUATION

1. Soft: fabric pliable with a light lubricated feel
2. Harsh: fabric stiff, rough, unpleasing to the touch
3. Dry: lack of lubricity
4. Limp: fabric lacks body The results of washing and drying the aforesaid fabrics using the compositions of Example I were as follows:

| | A | B | C | D | E |
|---|---|---|---|---|---|
| STATIC | severe | moderate | light | none | severe |
| SOFTNESS | soft, limp | harsh, dry | soft | soft | harsh, dry |

It should be noted that in the foregoing evaluations, the absence of the powdered nylon, or the propoxylated quaternary, or the quaternary ammonium chloride had an adverse softening and/or antistatic effect on the fabrics.

EXAMPLE III

Additional compositions in granular form were prepared and having the following components:

| COMPONENT | F | G | H | I | J | K |
|---|---|---|---|---|---|---|
| Carrier-light density STPP | 50.25 | 50.25 | 50.25 | 50.25 | 50.25 | 50.25 |
| Filler-sodium sulfate | 8.04 | 8.04 | 8.04 | 8.04 | 8.04 | 8.04 |
| Orgasol 1002D | 14.58 | 10.0 | 14.58 | 14.58 | 8.0 | 8.0 |
| Propoquad T/12* | 17.08 | 11.71 | 11.71 | 17.08 | 14.17 | 17.08 |
| Arquad T-27W** | 0.50 | 0.69 | 0.69 | 1.0 | 0.83 | 1.0 |
| Water | quantity sufficient | | | | | |
| TOTAL | 100.00 | 100.00 | 100.00 | 100.00 | 100.00 | 100.00 |

The foregoing compositions were evaluated in accordance with the procedures of Example II with the following results:

| | F | G | H | I | J | K |
|---|---|---|---|---|---|---|
| STATIC | none | none-slight | slight | none | none-slight | none |
| SOFTNESS | soft | medium soft | soft | soft | soft | soft |

EXAMPLE IV

Compositions in liquid form were prepared and having the following components:

| COMPONENT | L | M |
|---|---|---|
| Propoquad T/12* | 65.49 | 32.75 |
| Arquad T/27W** | 3.83 | 1.91 |
| Orgasol 1002D (nylon 6) | 30.67 | 15.34 |
| Sodium CMC | — | 2.0 |
| Perfume | — | 1.0 |
| $H_2O$ | — | 47.0 |

The foregoing compositions were evaluated in accordance with the procedures of Example II excepting the amount of the composition added to the wash cycle with the following results:

| | L | M |
|---|---|---|
| STATIC | None | None |
| SOFTNESS | Soft/dry | Soft/dry |

Composition L was designed to be a highly concentrated product without addition of any water. In evaluating this composition approximately about $\frac{2}{3}$ ounce (17.34 grams) was added to the wash cycle. Composition M is a somewhat diluted version of composition L and it was evaluated by adding about $1\frac{1}{4}$ ounces to the wash cycle following the procedures of Example II.

EXAMPLE V

A granular composition was prepared having the following components:

| COMPONENT | N |
|---|---|
| Carrier - light density | 50.0% |
| STPP | |
| Filler-sodium sulfate | 8.04 |
| Orgasol 2002D (nylon 12) | 8.00 |
| Propoquad T/12* | 17.08 |
| Arquad T-27W** | 1.00 |
| Water | 15.88 |
| TOTAL | 100.00% |

Composition N was evaluated according to the procedures of Example II with the following results:

| | |
|---|---|
| Static | None |
| Softness | Soft |

What is claimed is:

1. A composition capable of imparting softness and antistatic properties to fabrics treated therewith in the wash cycle of a laundering process comprising:

(1) an aliphatic cationic compound selected from the group consisting of:

(a) an ethoxylated quaternary ammonium compound characterized by the structure:

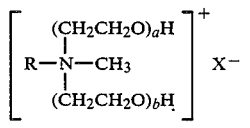

wherein R represents alkyl or alkenyl of 8–18 carbon atoms, each of a and b are at least 1 and the sum of a plus b is from 2 to 50 and X is $Cl^-$ or $CH_3SO_4^-$, (b) a propoxylated quaternary ammonium compound characterized by the structure:

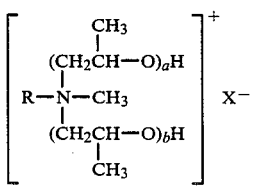

wherein R represents alkyl or alkenyl of 8–18 carbon atoms, each of a and b are at least 1 and the sum of a plus b is from 2 to 50 and X is $Cl^-$ or $CH_3SO_4^-$ and mixtures of (a) and (b), and (2) a mono long chain alkyl quaternary ammonium compound characterized by the structure:

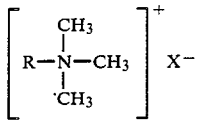

wherein R represents alkyl or alkenyl of 8 to 18 carbon atoms and X is $Cl^-$ or $CH_3SO_4^-$, and (3) powdered nylon, and wherein the ratio on a weight basis of said ethoxylated compound, said propoxylated compound and mixtures thereof to said mono long chain compound in said composition is from about 180:1 to about 18:1.

2. A composition according to claim 1 wherein the aliphatic cationic compound (1) is a propoxylated quaternary ammonium compound (b) and wherein said ratio is from about 40:1 to about 50:1.

3. A composition according to claim 2 wherein R of the propoxylated quaternary ammonium compound (b) is tallow and the sum of a plus b is 2.

4. A composition according to claim 3 wherein the mono long chain quaternary ammonium compound (2) R is tallow and X is $Cl^-$.

5. A composition according to claim 1 wherein the content of the aliphatic cationic compound (1) is at least about 7% by weight of the composition, the content of the mono long chain quaternary ammonium compound (2) is at least about 0.10% by weight of the composition and the content of the nylon powder (3) is at least about 8% by weight of the composition.

6. A composition according to claim 5 wherein the aliphatic cationic compound (1) is a propoxylated quaternary ammonium compound (b).

7. A composition according to claim 6 wherein R of the propoxylated quaternary ammonium compound (b) is tallow and the sum of a plus b is 2.

8. A composition according to claim 7 wherein the mono long chain alkyl quaternary ammonium compound (2) R is tallow, X is $Cl^-$ and the powdered nylon (3) is nylon 6.

9. A composition according to claim 5 in granular form wherein the content of the aliphatic cationic compound (1) is from about 7% to about 18% by weight of the composition, the content of the mono long chain quaternary ammonium compound (2) is from about 0.10% to about 1.0% by weight of the composition and the content of the nylon powder is from about 8% to about 15% by weight of the composition.

10. A composition according to claim 9 wherein the aliphatic cationic compound (1) is a propoxylated quaternary ammonium compound (b).

11. A composition according to claim 10 wherein R of the propoxylated quaternary ammonium compound (b) is tallow and the sum of a plus b is 2.

12. A composition according to claim 11 wherein the mono long chain quaternary ammonium compound (2) R is tallow and X is $Cl^-$ and the powdered nylon (3) is nylon 6.

13. A composition according to claim 12 wherein the content of the propoxylated quaternary ammonium compound (b) is about 13% by weight of the composition, the content of the mono long chain quaternary ammonium compound (2) is about 0.30% by weight of the composition, and the content of the powdered nylon (3) is from about 14–15% by weight of the composition.

14. A composition according to claim 13 wherein said powdered nylon (3) is nylon 12 and wherein the content of said nylon 12 is about 8% by weight of the composition.

* * * * *